US008502674B1

(12) United States Patent
Cole

(10) Patent No.: US 8,502,674 B1
(45) Date of Patent: Aug. 6, 2013

(54) MONITORING THE LOCATION OF AN OBJECT USING A MOBILE DEVICE

(75) Inventor: Joshua R. Cole, Overland Park, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 1226 days.

(21) Appl. No.: 12/206,140

(22) Filed: Sep. 8, 2008

(51) Int. Cl.
*G08B 13/14* (2006.01)

(52) U.S. Cl.
USPC ..... 340/572.4; 340/568.1; 340/572.1

(58) Field of Classification Search
USPC ..... 340/10.1, 5.92, 539.11–539.14
See application file for complete search history.

(56) References Cited

U.S. PATENT DOCUMENTS 4,549,169 A * 10/1985 Moura et al. ..... 340/539.26
5,751,246 A * 5/1998 Hertel ..... 342/357.31
6,624,752 B2 * 9/2003 Klitsgaard et al. ..... 340/572.1
7,053,775 B2 5/2006 Moore
2001/0000019 A1 * 3/2001 Bowers et al. ..... 340/572.1
2005/0040974 A1 * 2/2005 Shanks et al. ..... 341/53
2005/0068170 A1 * 3/2005 Aupperle et al. ..... 340/539.15
2006/0066449 A1 * 3/2006 Johnson ..... 340/539.12

OTHER PUBLICATIONS

Roger Smith, "RFID: A Brief Technology Analysis," CTOnet, http://www.idspackaging.com/Common/Paper/Paper_253/RFID_A%20Brief%20Technology%20Analysis.htm, 2006, pp. 1-6.
Matt Hamblen, "RFID Heading to Cell Phones," InfoWorld, http://www.infoworld.com/article/07/09/19/RFID-heading-to-cell-phones_1.html, 2007, pp. 1-2.

* cited by examiner

*Primary Examiner* — Daniel Wu
*Assistant Examiner* — Frederick Ott

(57) ABSTRACT

A method, system, and medium are provided for monitoring a location of an object using a mobile device, including emitting from the mobile device a radio frequency (RF) signal that activates a radio frequency identifier tag ("RFID tag") located within a broadcast area (the RFID tag being affixed to the object); receiving at the mobile device an RF signal generated by the RFID tag; determining that the RFID tag is registered among a set of RFID tags that are to be tracked; determining that the RFID tag is not located within the broadcast area; and emitting by way of the mobile device an alert that indicates that the RFID tag is not located within the broadcast area.

20 Claims, 8 Drawing Sheets

MONITORING THE LOCATION OF AN OBJECT USING A MOBILE DEVICE

SUMMARY

Embodiments of the invention are defined by the claims below, not this summary. A high-level overview of embodiments of the invention are provided here for that reason, to provide an overview of the disclosure.

In a first aspect, a set of embodied computer-useable instructions provide a method of monitoring a location of an object using a mobile device that includes emitting from the mobile device a radio frequency (RF) signal that activates a radio frequency identifier tag ("RFID tag") located within a broadcast area (the RFID tag being affixed to the object); receiving at the mobile device an RF signal generated by the RFID tag; determining that the RFID tag is registered among a set of RFID tags that are to be tracked; determining that the RFID tag is not located within the broadcast area; and emitting by way of the mobile device an alert that indicates that the RFID tag is not located within the broadcast area.

In another aspect, a system for monitoring a location of an object includes a radio frequency identifier (RFID) tag affixed to the object and a mobile device for emitting and receiving radio frequency (RF) signals. In one embodiment, the mobile device includes an RF signal emitter that emits the RF signal, which defines a broadcast area. The RF signal is capable of activating the RFID tag, which is located within the broadcast area. The mobile device also includes an RF signal receiver that receives a return signal from the RFID tag; data-storage media that stores data regarding the RFID tag (including an RFID tag identifier, at least one attribute of the object being tracked by the RFID tag, and an alert, which is executed when the RFID tag is not located within the broadcast area); a processor that determines if an RF signal received by the receiver originated from the RFID tag, determines that the RFID tag is not located in the broadcast area, and executes the alert when the RFID tag is not located within the broadcast area; and a display that presents a user interface that enables interaction with the alert behavior.

In a final illustrative aspect, a method of registering an object for tracking using a mobile device is provided. The method includes receiving a passive radio frequency identifier tag ("RFID tag") that uniquely identifies an RFID tag that is affixed to the object; receiving at least one attribute of the object; receiving a desired alert, wherein the alert indicates that the object is no longer within a threshold proximity of the mobile device; and storing the RFID tag identifier, the at least one attribute, and the desired alert in a registry of objects that are to be tracked by the mobile device.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Embodiments of the present invention provide a system and method for monitoring the location of an object using a mobile device.

The subject matter of the present invention is described with specificity herein to meet statutory requirements. However, the description itself is not intended to limit the scope of this patent. Rather, the inventor has contemplated that the claimed subject matter might also be embodied in other ways, to include different steps or combinations of steps similar to the ones described in this document, in conjunction with other present or future technologies. Moreover, although the terms "step" and/or "block" may be used herein to connote different components of methods employed, the terms should not be interpreted as implying any particular order among or between various steps herein disclosed unless and except when the order of individual steps is explicitly described.

Embodiments of the present invention may be embodied as, among other things: a method, system, or computer-program product. Accordingly, the embodiments may take the form of a hardware embodiment, a software embodiment, or an embodiment combining software and hardware. In one embodiment, the present invention takes the form of a computer-program product that includes computer-useable instructions embodied on one or more computer-readable media.

Computer-readable media include both volatile and nonvolatile media, removable and nonremovable media, and contemplates media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently.

Figure 1:
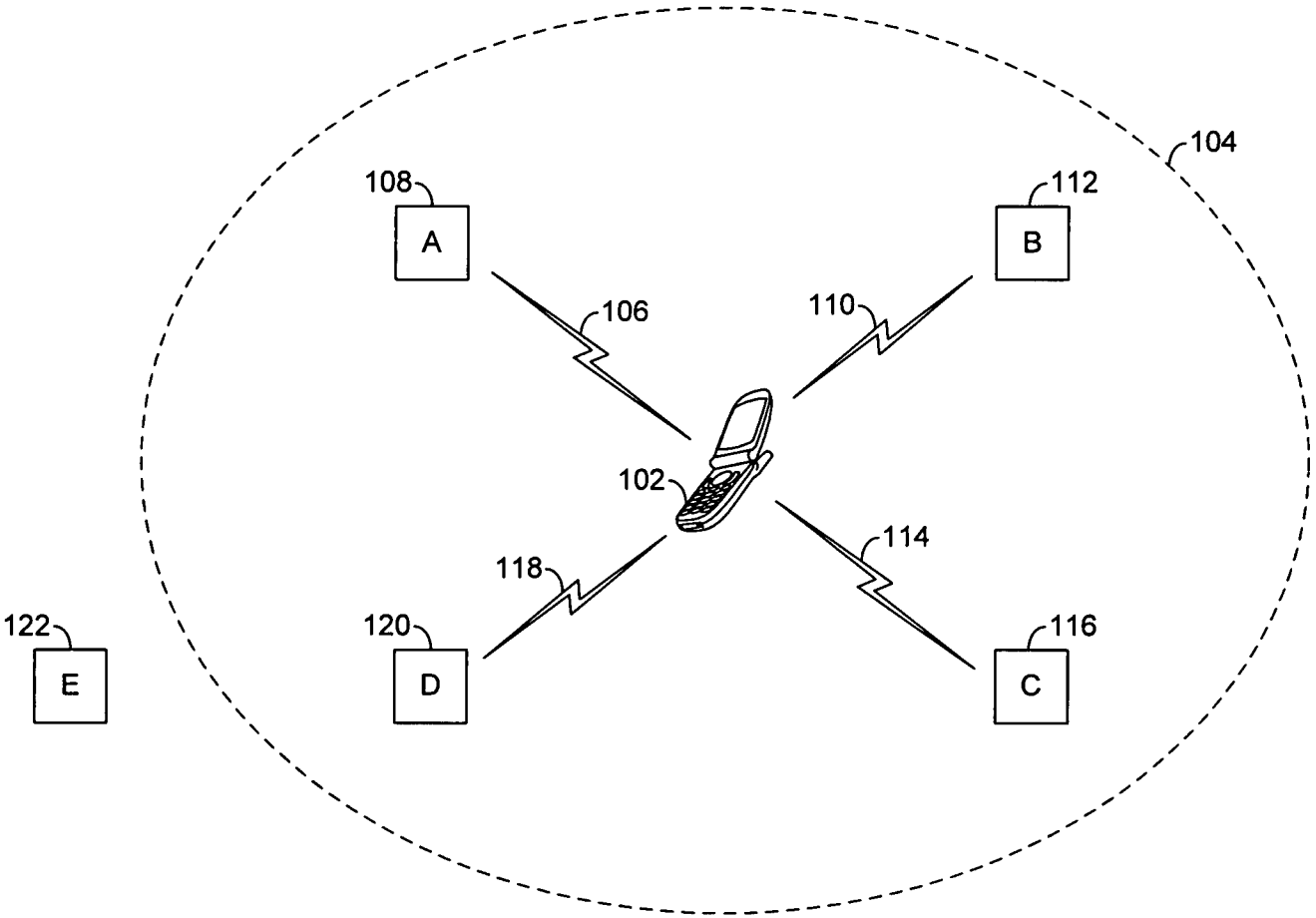
FIG. 1 depicts an illustrative operating environment for performing a method of monitoring the location of a plurality of objects using a mobile device in accordance with an embodiment of the present invention.

FIG. 1 depicts an illustrative operating environment for performing a method of monitoring the location of a plurality of objects using a mobile device. Mobile device 102 emits a radio frequency ("RF") signal thereby creating a broadcast area 104. The RF signal emitted by mobile device 102 activates a plurality of radio frequency identifier tags ("RFID tag"), A 108, B 112, C 116, and D 120, which are located within a broadcast area 104. Each RFID tag is affixed to an object whose position is to be tracked by mobile device 102. An additional RFID tag E 122 is located outside of broadcast area 104, and is therefore not being activated by the RF signal being emitted by mobile device 102.

Mobile device 102 could be a cell phone, a PDA, a computer, a laptop computer, or some other communications device. In general, mobile device 102 includes a user interface, a wireless communications interface, a processor, and a data storage component in one embodiment. The user interface may include buttons, a touch screen, a microprocessor, or other elements. The wireless communication interface may comprise an antenna and a chipset for communicating with one or more radio frequency identifier tags ("RFID tag") over an air interface. For instance, the chipset could be suitable for engaging in communications with near-field (ISO-14443) to far-field (ISO-18000-6) passive RFID tags. Alternatively, the chipset may be suitable for engaging in communications with active or semipassive RFID tags. The antenna must emit a radio frequency (RF) signal powerful enough to activate an RFID tag within the broadcast area 104. The RF signals utilized by GSM, CDMA, or other RF networks should suffice. The processor and data storage media may be any suitable component known to those of skill in the art.

The RFID tags 108, 112, 116, 120, and 122 may be active, passive, or semi-passive in different embodiments. However, passive RFID tags are preferred in most instances because they need no power source. Active or semi-passive RFID tags, in other embodiments are capable of monitoring their own power status in order to provide a warning when they are in danger of powering down due to an end-of-life or failure condition so that the reader does not misinterpret the functional absence of the tag from the monitored environment as an absence of the tag itself. In one embodiment, the ambient RF signal emitted by mobile device 102 is utilized to activate the RFID tag. The RFID tags respond to the same RF range as used by mobile device 102. In this instance, the broadcast area 104 may only exist in the immediate vicinity of mobile device 102. Additionally, more than one mobile device may be tracking each RFID tag.

In an alternate embodiment, mobile device 102 may contain a separate RF signal transmitter/receiver that is separate from the RF signal transmitter/receiver used by mobile device 102 to communicate with a wireless network. In this instance, a separate RF signal band may be used as to achieve larger broadcast areas. In this case, the RFID tags must be manufactured to respond to this special RF signal band.

The size of broadcast area 104 may also depend on the sensitivity and range of RFID tags used. For instance, near-field passive RFID tags may be used to achieve a maximum broadcast area of ten meters. One such standard for near-field passive RFID tags is given by ISO-14443. Additionally if a larger broadcast area is preferred, far-field passive RFID tags could be used to achieve a maximum broadcast area of 183 meters. One example of a far-field passive RFID tag is given by International Standard ISO-18000-6. Many other types of RFID tags may be used depending on the desired size of broadcast area 104. RFID tags are well known in the art.

Returning to FIG. 1, mobile device 102 emits an RF signal 106, 110, 114, and 118, which activates RFID tags 108, 112, 116, and 120. Note that while RF signals 106, 110, 114, and 118 are shown separately, the signal emitted by mobile device 102 that activates RFID tags 108, 112, 116, and 120 is the same signal. Once activated, each RFID tag sends a separate RF signal 106, 110, 114, and 118 back to mobile device 102. These signals uniquely identify each RFID tag. Tag E 122 does not receive RF signals from or send RF signals to mobile device 102 because it is not located within broadcast area 104. Optimally, broadcast area 104 will be within close proximity to mobile device 102 as to provide the most usefulness in tracking objects 108, 112, 116, and 120.

Figure 2:
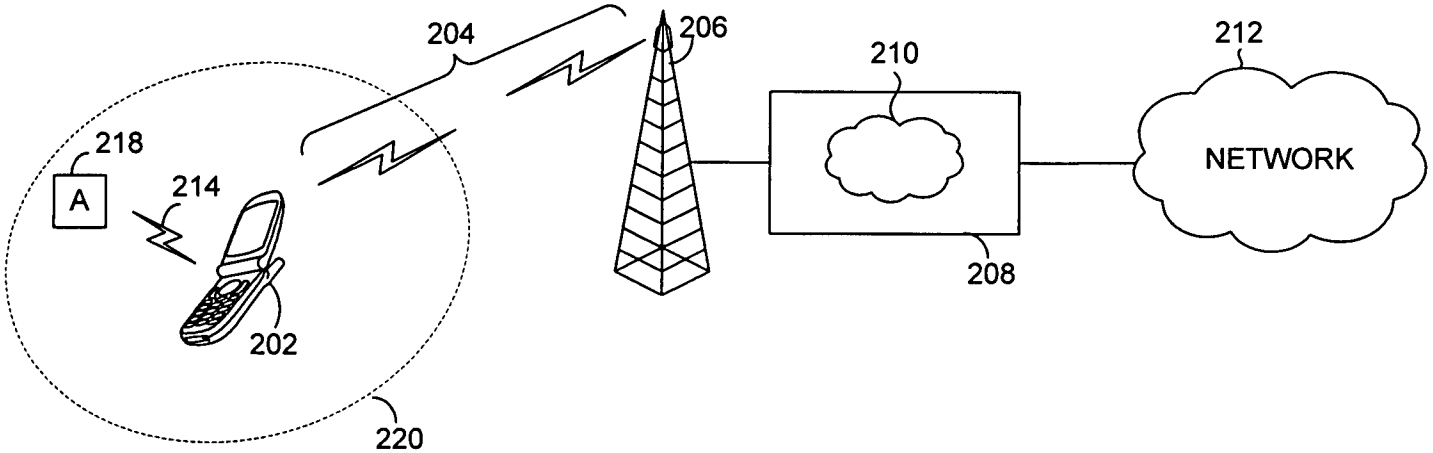
FIG. 2 depicts another illustrative operating environment for performing a method of monitoring the location of an object using a mobile device in accordance with an embodiment of the present invention.

FIG. 2 depicts another illustrative operating environment for performing the method of the present invention. Mobile device 202 is in communication 204 with an access node 206 of a wireless communications network. The access node is connected to a network element 208 containing computer-readable media 210. Network element 208 is in turn connected to a network 212. The network 212 may include one or more networks, which might be of different types, such as wide-area networks, local-area networks, public networks such as the Internet, private networks, wired networks, wireless networks, or networks of any other variety.

Access node 206 may be any one or any combination of network elements. As such, the access node may include a communication interface, a processor, and a data storage component. The communication interface may include one or more antennas, chipsets, or other components for providing one or more wireless coverage areas such as cells or sectors for communicating with mobile devices. The communication interface may also include a wired packet interface such as an Ethernet interface for communicating directly, or over one or more networks. Access node 206 may include one or more base transceiver stations (BTS) as well as one or more radio network controllers (RNC). Access node 206 may be in communication with a plurality of mobile devices.

Mobile device 202 is also emitting an RF signal 214 which activates RFID tag 218 which is affixed to an object that is to be tracked. Although only one RFID tag is shown, a plurality of RFID tags may be present as in FIG. 1. The discussions regarding mobile device 102 and the plurality of RFID tags 108, 112, 116, and 120 from FIG. 1 apply to mobile device 202 and RFID tag 218 as well. Once activated, RFID tag 218 sends an RF signal 214 back to mobile device 202. The sensitivity and range of the RFID tag 218 along with the type of RF signal utilized by mobile device 202 defines the size of broadcast area 220. RFID tags located within broadcast area 220 will be activated by the RF signal 214 being emitted by mobile device 202.

The RF signal 214 generated by the activated RFID tag 218 contains the tag's unique identifier. This unique identifier may be stored on mobile device 202, computer-readable media 210, or both. Additional data such as object attributes, data relating to validation procedures, and alert behaviors may be stored in both of these places. Additionally, a user may add, edit or delete this data using mobile device 202, network 212, or both. For example, a user may enter such data via a web interface on network 212. Data may also be transferred between computer-readable media 210 and mobile device 202.

Figure 3:
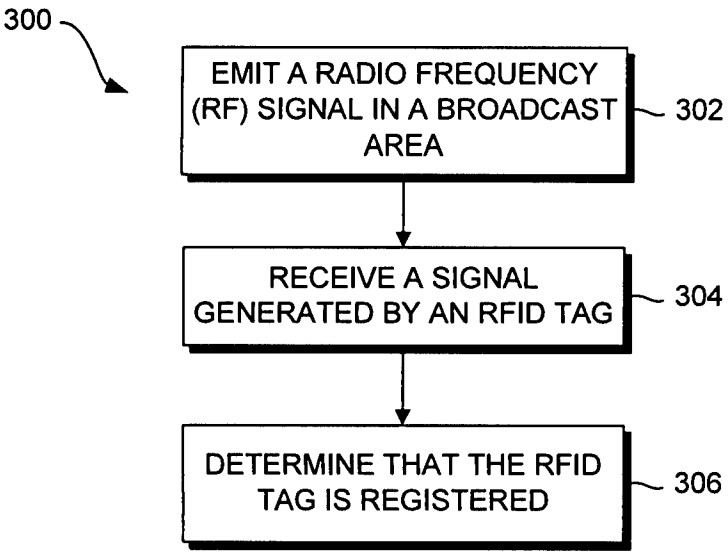
FIG. 3 depicts a flow diagram for a method of monitoring the location of an object using a mobile device.

FIG. 3 depicts a flow diagram that depicts a method for tracking an object with an RFID tag in a broadcast area. Method 300 begins in step 302 when an RF signal is emitted that activates RFID tags located within a broadcast area. In step 304, an RF signal generated by an RFID tag located in the broadcast area is received, and in step 306, the mobile device determines that the RF signal received uniquely identifies an RFID tag that is registered among a set of RFID tag identifiers that are to be tracked. Determining that the RFID tag is registered may include referencing its unique identifier against a set of registered RFID tag identifiers. In one embodiment once it is determined that the RFID tag is located within the broadcast area, a user is alerted if the tag previously was not in the broadcast area. In another embodiment, the user is not alerted when a registered object is located within the broadcast area regardless of if it was not previously located within the broadcast area.

Figure 4:
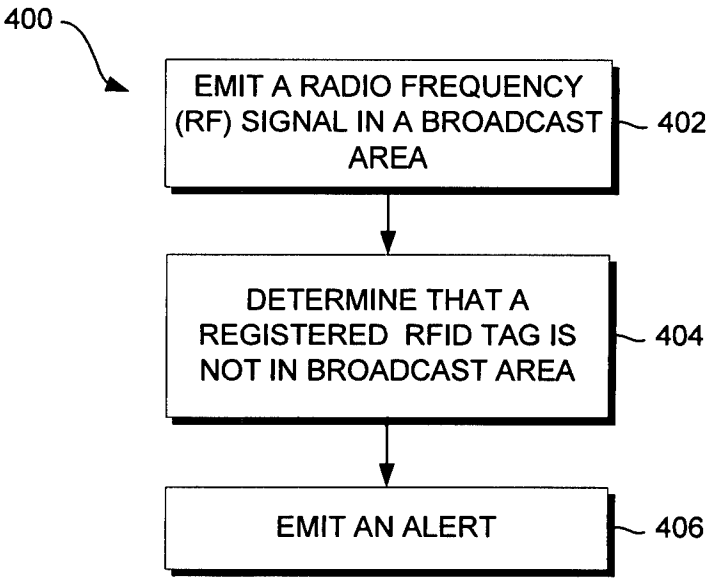
FIG. 4 depicts another flow diagram for a method of monitoring the location of an object using a mobile device.

FIG. 4 depicts a flow diagram for a method for tracking an object with an RFID tag that is not located within a broadcast area. The method 400 begins in step 402 when an RF signal is emitted that activates RFID tags located within a broadcast area. In step 404, it is determined that an RFID tag registered in a set of RFID tags to be tracked is not sending a signal so is therefore not located within the broadcast area. This may be determined by referencing a set of RFID tag identifiers derived from received RF signals against the set of registered RFID tags. In step 406, an alert is emitted, which indicates that the RFID tag is not located within the broadcast area. The alert could be user defined, or it could be a default alert defined by the system. In one embodiment, the alert actively informs a user by emitting an audible noise, displaying a message, vibrating, etc. In another embodiment, the alert passively informs the user by waiting for a user prompt, not displaying anything, etc.

Figure 5:
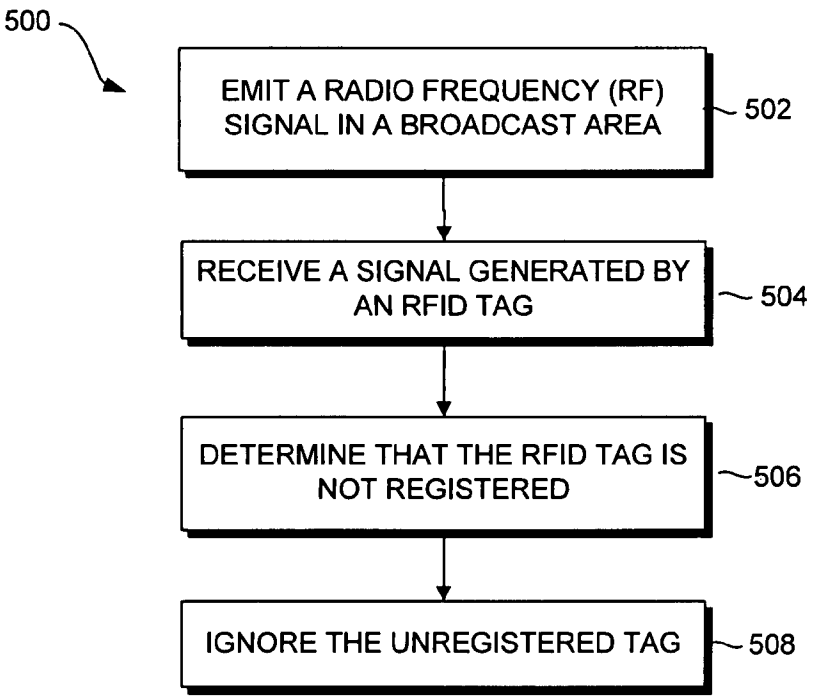
FIG. 5 depicts yet another flow diagram for a method of monitoring the location of an object using a mobile device.

FIG. 5 depicts a flow diagram for a method of tracking an object with an RFID tag in a broadcast area. Method 500 begins in step 502 when an RF signal is emitted that activates RFID tags located within the broadcast area. In step 504, an RF signal is received that was generated by an RFID tag located within the broadcast area. In step 506, it is determined that the unique identifier given by the received RF signal does not match any identifiers of registered RFID tags. It is assumed that unregistered RFID tags are not to be tracked and therefore, in step 508, the unregistered tag is ignored.

Figure 6:
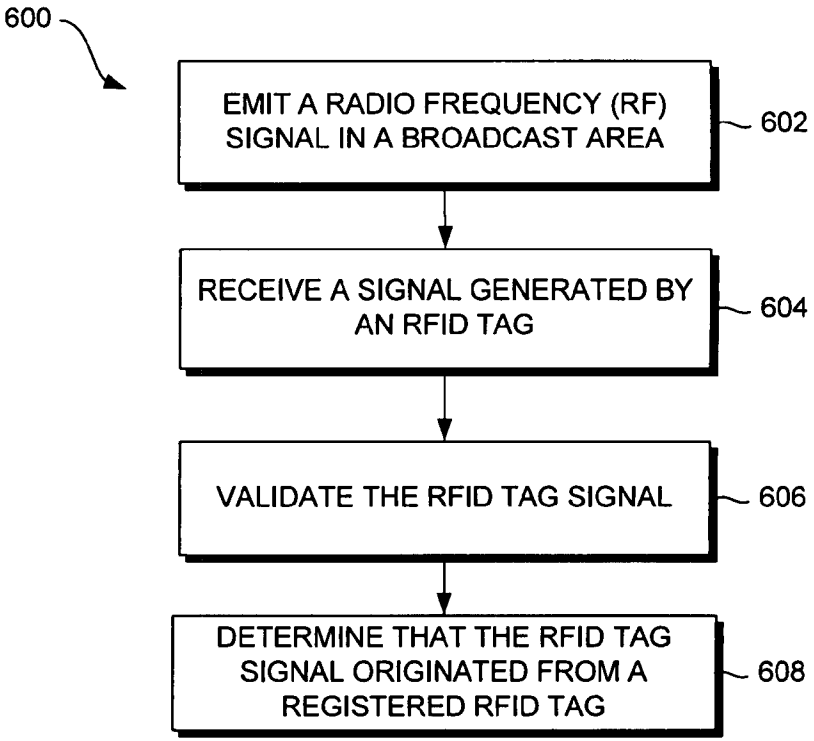
FIG. 6 depicts another flow diagram for a method of monitoring the location of an object using a mobile device.

FIG. 6 depicts a flow diagram for performing a method 600 for securely tracking an object with an RFID tag in a broadcast area. In step 602, an RF signal is emitted which activates RFID tags located within a broadcast area. In step 604, an RF signal is received that was generated by an activated RFID tag. In step 606, the RF signal is validated. The validation could be accomplished by using a two-stage key or similar method. Further validation methods are discussed in FIG. 9. Once it is determined that the RFID tag signal is valid, then in step 608, it is determined that the RFID tag originated from an RFID tag which is among the set of registered RFID tags.

Figure 7:
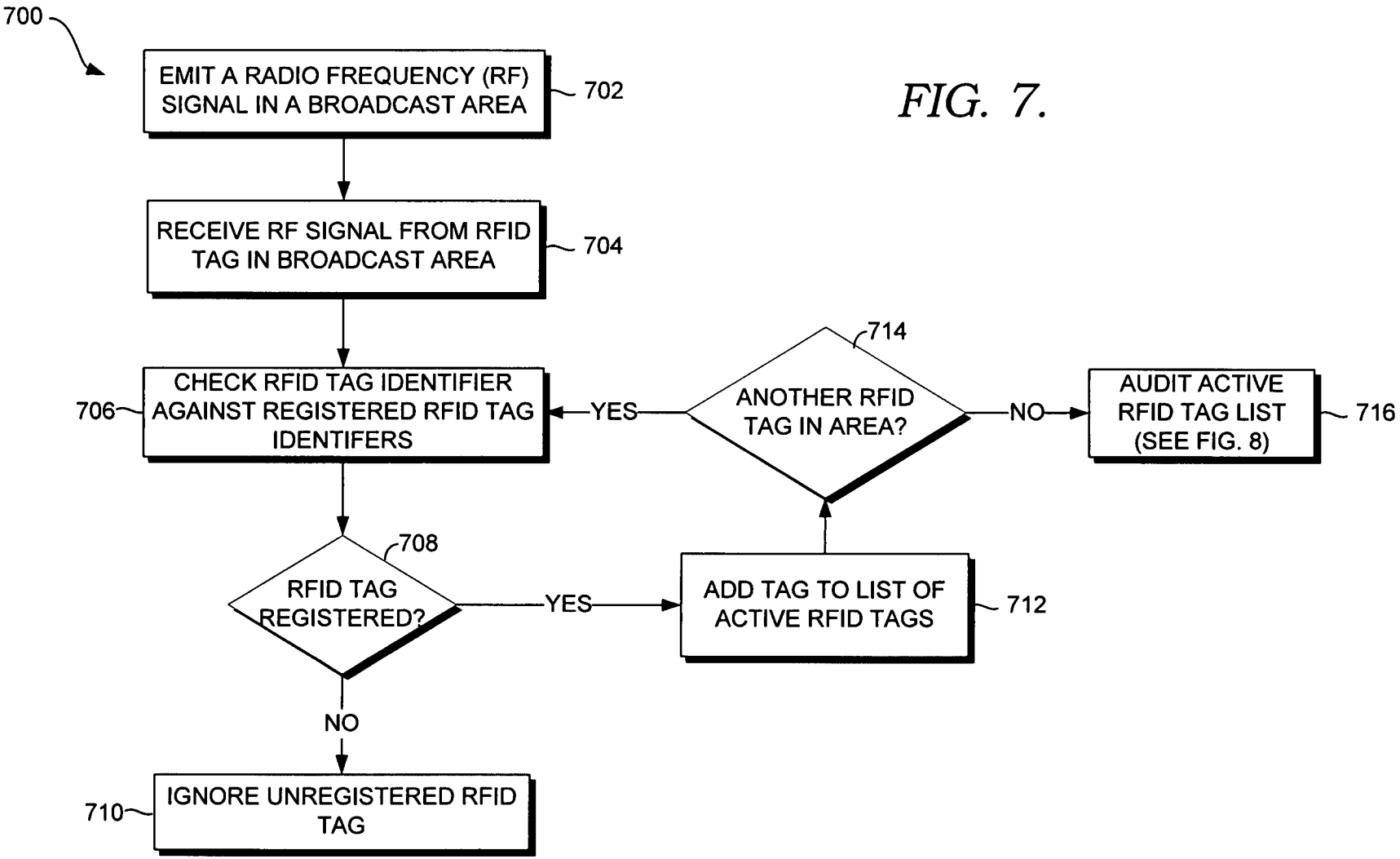
FIG. 7 depicts a more detailed flow diagram for a method of monitoring the location of an object using a mobile device.

FIG. 7 depicts a more detailed flow diagram for a method of monitoring the location of a plurality of objects using a mobile device. The method 700 begins in step 702, where an RF signal is emitted that activates any RFID tags located within a broadcast area. In step 704, an RF signal generated by one of the activated RFID tags in the broadcast area is received. In step 706, an RFID tag identifier is determined using the received RF signal, and this identifier is referenced against a set of registered RFID tag identifiers. If it is determined that the RFID tag identifier does not belong to a registered RFID tag in step 708, then the unregistered tag is ignored in step 710. However, returning to step 708, if it is determined that the RFID tag identifier does belong to a registered RFID, then the RFID tag identifier is added to a list of active RFID tag identifiers in step 712. This list of active RFID tag identifiers contains identifiers for all registered RFID tags that are transmitting RF signals and therefore located within the broadcast area. The active RFID tag list may be used to determine if any registered RFID tags are not located within the broadcast area. This process is described in detail in FIG. 8.

In decision step 714, it is determined if any other RF signals generated by other RFID tags located within the broadcast area are being received. If no other RF signals are being received, then the system idles until either a new RF signal is received or until one of the RF signals generated by an RFID tag in the active registered RFID tag stops being received. Returning to 714, if another RF signal is being received, then the system returns to step 706. This process is repeated until all RFID tags located within the broadcast area are accounted for.

Figure 8:
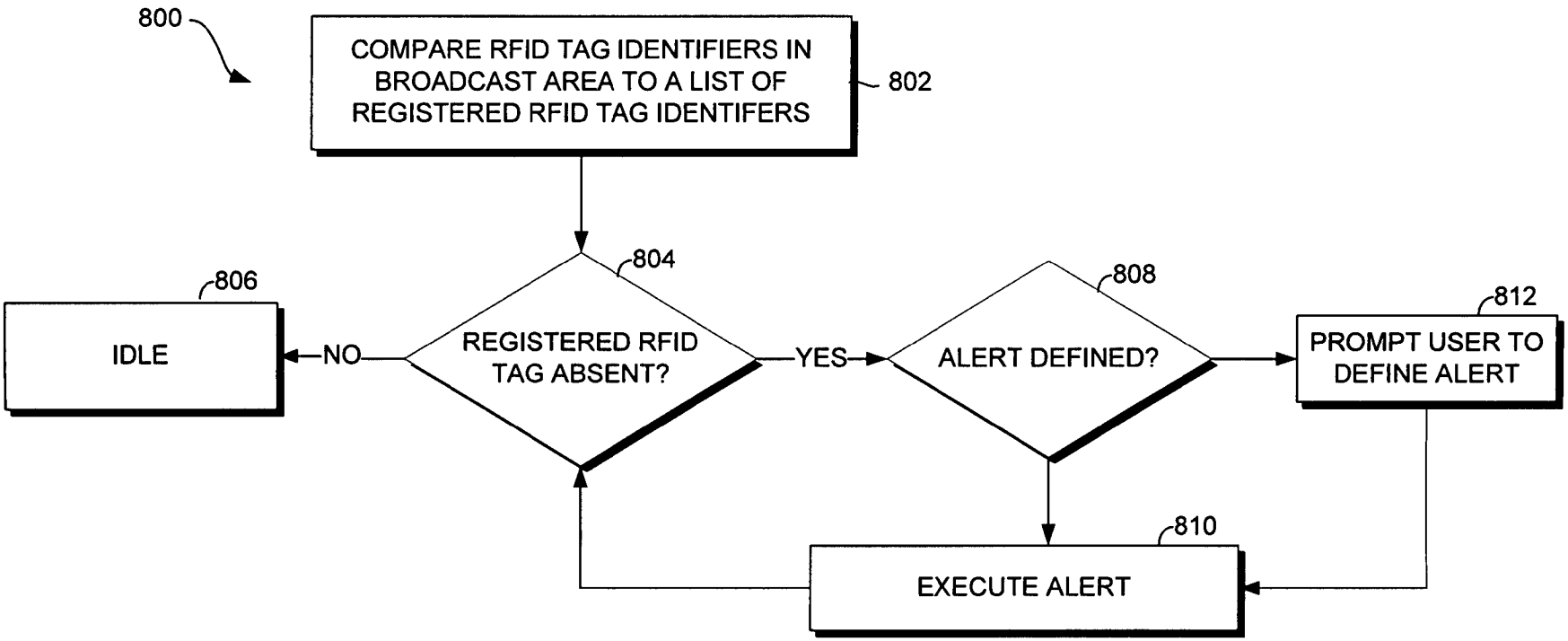
FIG. 8 depicts another detailed flow diagram for a method of monitoring the location of an object using a mobile device.

FIG. 8 is another flow diagram that depicts a method for auditing a list of active RFID tags as previously mentioned in step 716 of FIG. 7. The method 800 begins in step 802 where a list of RFID tag identifiers representing all registered RFID tags that are actively transmitting RF signals ("active list") is compared to a set of all RFID tag identifiers representing RFID tags that are to be tracked ("registered set"). In step 804, it is determined if any RFID tag identifiers in the registered set are not among the RFID tag identifiers in the active list. If all registered RFID tags are present, then in step 806, the system may idle. In another embodiment, the system may then perform the method depicted in FIG. 7 to start the process over again.

Returning to step 804, if a registered RFID tag is not present, then the system determines if an alert has been defined for the RFID tag in step 808. If the RFID tag has an alert defined, then in step 810, the alert is executed, and the system returns to step 804. If no alert is defined for the RFID tag, then in step 812, the user is prompted to define an alert, which is then executed in step 810. As discussed previously in FIG. 4, the alerts could be user defined or default alerts defined by the system. Once the alert is executed, the system returns to step 804, which continues the process until all registered RFID tags are either accounted for or alerts given.

Figure 9:
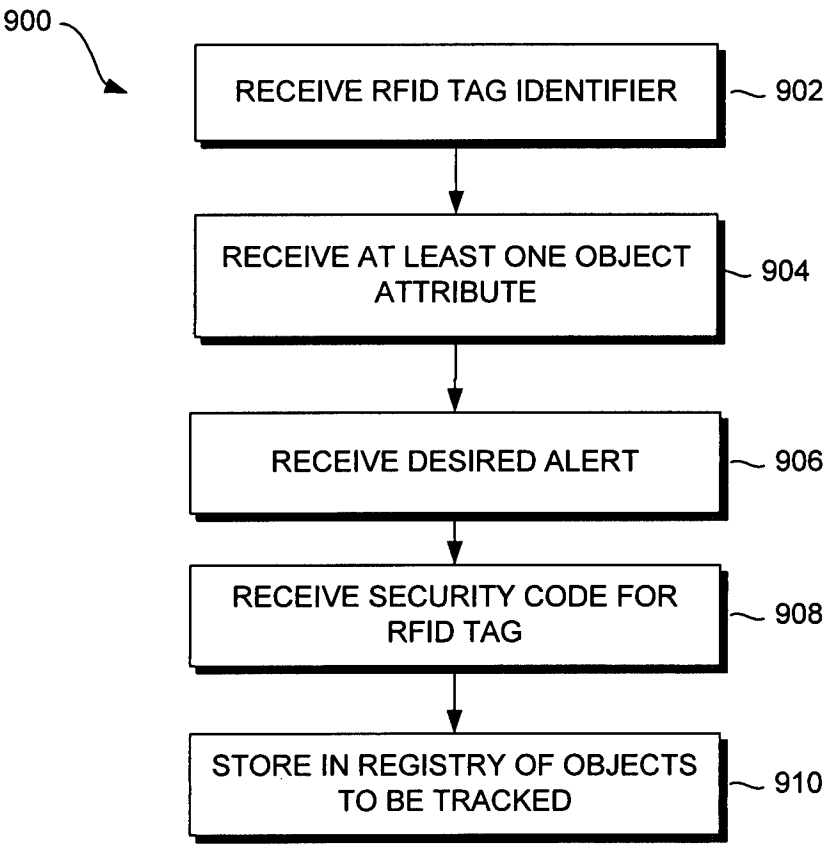
FIG. 9 depicts a flow diagram for a method of registering an object for tracking using a mobile device.

FIG. 9 depicts a flow diagram for a method of registering an object that is to be tracked using a mobile device. The method 900 begins in step 902 where an RFID tag identifier is received. It is presumed that the RFID tag is affixed to the object that is to be tracked. In step 904, at least one object attribute is received. An object attribute may be an object name, an object description, or any other attribute that the user might want to associate with the object. In step 906, an alert is received, which will execute once the object is outside of the broadcast area. In step 908, a security code for the RFID tag is received. The security code is used to assist in validating the RFID tag signal when received by the mobile device. The security code may be part of a two-part key to be used on the mobile device. The two-part key process may consist of appending the security code to the unique RFID tag identifier so that when an RF signal is received from an RFID tag, the tag will be tracked only if a security code is defined. Additional authorization procedures may be used in combination with the wireless communications network as disclosed in FIG. 2. Note that steps 902-908 could be performed in any order. In step 910, the data received in steps 902-908 is stored in the registry of objects to be tracked.

Figure 10:
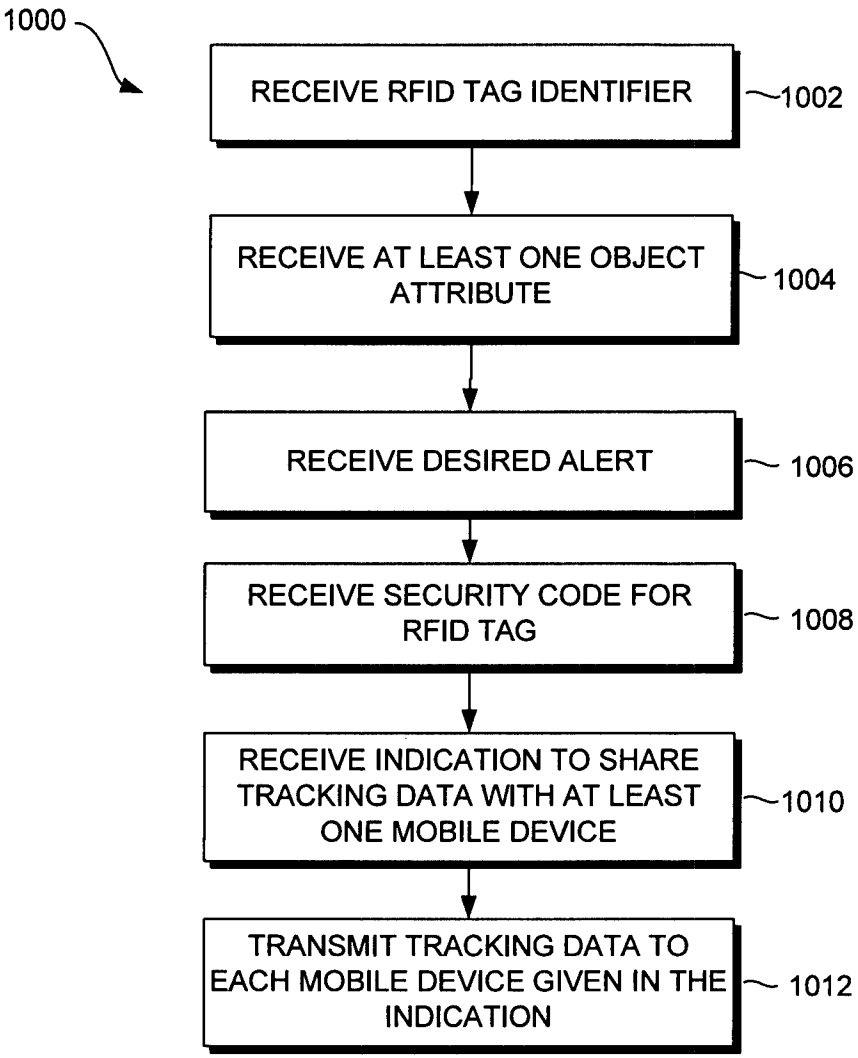
FIG. 10 depicts a flow diagram for an alternate embodiment of a method of registering an object for tracking using a mobile device.

FIG. 10 depicts a flow diagram for an alternate embodiment of a method for registering an object for tracking using a mobile device. The method 1000 is to be performed, for instance, on network element 208 of FIG. 2. In step 1002, an RFID tag identifier is received. In step 1004, at least one object attribute is received. In step 1006, an alert is received, which will execute once the object is outside of the broadcast area. In step 1008, a security code for the RFID tag is received. All of this tracking data received in steps 1002-1008 was described in reference to FIG. 9. Note that steps 1002-1008 could be performed in any order. In step 1010, an indication is received that the tracking information received above should be shared with at least one mobile device. As indicated previously during the discussion of FIG. 2, a user may enter this data via a network such as the Internet. In step 1012, the tracking data is wirelessly transmitted to all of the mobile devices given in the indication of step 1010. These mobile devices may then begin tracking the object using methods disclosed above.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. One or more non-transitory computer-readable media having computer-useable instructions embodied thereon for performing a method of monitoring a location of an object using a mobile device, the method comprising:

emitting from the mobile device a radio frequency (RF) signal that activates a radio frequency identifier tag ("RFID tag") located within a broadcast area, wherein the RFID tag is affixed to the object;

receiving at the mobile device an RF signal generated by the RFID tag;

determining that the RFID tag is registered among a set of RFID tags that are to be tracked, wherein determining that the RFID tag is registered among a set of RFID tags that are to be tracked includes accessing stored data regarding the set of RFID tags, and wherein the data is able to be shared with one or more other mobile devices such that the one or more other mobile devices may monitor the location of one or more of the objects;

determining that the RFID tag is not located within the broadcast area; and determining whether an alert has been defined for the RFID tag, wherein (1) when the alert has been defined for the RFID tag, providing by way of the mobile device an alert that indicates that the RFID tag is not located within the broadcast area, wherein the alert is provided in accordance with the defined alert for the RFID tag, and (2) when the alert has not been defined for the RFID tag, prompting a user to define the alert via the mobile device.

2. The media of claim 1, wherein the RFID tag is one tag among a plurality of RFID tags.

3. The media of claim 1, wherein the alert is defined by a user.

4. The media of claim 1, wherein the alert is a default alert.

5. The media of claim 1, wherein determining that the RFID tag is registered among a set of RFID tags comprises:

deriving an RFID tag identifier from the RF signal generated by the RFID tag; and referencing the RFID tag identifier against a set of RFID tag identifiers for the set of RFID tags that are to be tracked.

6. The media of claim 1, wherein the alert displays a message indicating the object's location relative to the mobile device when prompted by a user.

7. The media of claim 1, wherein the alert actively informs a user as to the object's location relative to the mobile device.

8. The media of claim 7, wherein the alert actively informs by at least one of the following: emitting an audible noise, presenting a message, and vibrating the mobile device.

9. The media of claim 1, wherein determining that the RFID tag is not located within the broadcast area comprises:

compiling a set of RFID tags that are currently transmitting RF signals to the mobile device;

referencing the set of RFID tags that are currently transmitting RF signals against a set of RFID tags that are to be tracked; and determining that the RFID tag is not among the set of RFID tags that are currently transmitting RF signals to the mobile device.

10. The media of claim 1, further comprising:

receiving at the mobile device a second RF signal generated by a second RFID tag;

determining that the second RFID tag is not among the set of RFID tags that are to be tracked; and ignoring the second RFID tag.

11. A system for monitoring a location of an object, the system comprising:

a radio frequency identifier (RFID) tag affixed to the object; and a mobile device for emitting and receiving radio frequency (RF) signals, the mobile device comprising:

(1) an RF signal emitter that emits the RF signal, thereby defining a broadcast area, wherein the RF signal is capable of activating the RFID tag, which is located within the broadcast area;

(2) an RF signal receiver that receives a return signal from the RFID tag;

(3) one or more data-storage media that stores data regarding the RFID tag including an RFID tag identifier, at least one attribute of the object being tracked by the RFID tag, and a defined alert associated with the RFID tag, which is executed when the RFID tag is not located within the broadcast area, wherein said data is able to be shared with one or more other mobile devices such that the one or more other mobile devices may monitor the location of one or more of the objects;

(4) a processor that determines if an RF signal received by the receiver originated from the RFID tag, determines that the RFID tag is not located in the broadcast area, determines that the RFID tag is associated with the defined alert, and executes the alert when the RFID tag is not located within the broadcast area; and (5) a display that presents a user interface that enables interaction with the alert behavior.

12. The system of claim 11, wherein the broadcast area is an area within a predetermined proximity to the mobile device.

13. The system of claim 11, wherein the RFID tag is passive.

14. The system of claim 11, wherein the RFID tag is active, and is capable of providing a warning when its power source drops below a threshold level, thereby preventing a false positive that it is not located within the broadcast area.

15. The system of claim 11, wherein the at least one attribute includes at least one of an object name and an object description.

16. One or more non-transitory computer-readable media having computer-useable instructions embodied thereon for performing a method of registering objects for tracking using a mobile device, the method comprising:

receiving a first passive radio frequency identifier tag ("RFID tag") identifier and a second RFID tag, wherein the first RFID tag identifier uniquely identifies a first RFID tag that is affixed to a first object and the second RFID tag uniquely identifies a second RFID tag that is affixed to a second object;

receiving at least one attribute of the first object and at least one attribute of the second object;

receiving a first type of alert for the first RFID tag and a second type of alert for the second RFID type, wherein the first and second types of alerts indicates that the first and second objects are no longer within a threshold proximity of the mobile device;

storing the first and second RFID tag identifiers, the at least one attribute of the first and second objects, and the first and second types of alerts for the first and second RFID tags in a registry of objects that are to be tracked by the mobile device, wherein said registry of objects is accessible by multiple mobile devices for tracking one or more of the objects;

determining that one of the first RFID tag or the second RFID tag is not located within a broadcast area;

accessing the registry of objects to identify a type of alert to provide via the mobile device, wherein the first type of alert is identified when the first RFID tag is determined to be outside the broadcast area and the second type of alert is identified when the second RFID is determined to be outside the broadcast area; and providing by way of the mobile device an alert that indicates that the RFID tag is not located within the broadcast area, wherein the alert is provided in accordance with the first type of alert for the first RFID tag or the second type of alert for the second RFID tag.

17. The media of claim 16, further comprising:

receiving a security code for the first RFID tag; and storing the security code in the registry of objects that are to be tracked by the mobile device.

18. The media of claim 16, wherein the at least one first attribute includes at least one of an object name and an object description.

19. The media of claim 16, wherein the first type of alert is a default alert.

20. The media of claim 16, wherein the first type of alert is defined by a user.

* * * * *